US010937253B2

(12) United States Patent
Dey et al.

(10) Patent No.: US 10,937,253 B2
(45) Date of Patent: Mar. 2, 2021

(54) VALIDATION OF VEHICLE DATA VIA BLOCKCHAIN

(71) Applicant: International Business Machines Corporation, Armonk, NY (US)

(72) Inventors: Kuntal Dey, New Delhi (IN); Seema Nagar, Bangalore (IN); Meenal Kapoor, Gurgaon (IN); Vinayak Sastri, Bangalore (IN)

(73) Assignee: International Business Machines Corporation, Armonk, NY (US)

( * ) Notice: Subject to any disclaimer, the term of this patent is extended or adjusted under 35 U.S.C. 154(b) by 283 days.

(21) Appl. No.: 16/004,669

(22) Filed: Jun. 11, 2018

(65) Prior Publication Data

US 2019/0378352 A1 Dec. 12, 2019

(51) Int. Cl.
*G07C 5/00* (2006.01)
*G07C 5/08* (2006.01)

(52) U.S. Cl.
CPC ..... *G07C 5/006* (2013.01); *G07C 5/008* (2013.01); *G07C 5/0841* (2013.01)

(58) Field of Classification Search
CPC ..... G07C 5/006; G07C 5/008; G07C 5/0841; G07C 5/0808; G07C 5/0816; H04L 2209/04; H04L 2209/38; H04L 2209/84; G06Q 2220/00; G05D 2201/02; G05D 2201/0213; G05D 2201/0212
USPC ..... 701/31.4, 117, 29.1, 31.5, 31.6, 517
See application file for complete search history.

(56) References Cited

U.S. PATENT DOCUMENTS 6,401,027 B1 * 6/2002 Xu ..... G08G 1/0104 340/988
8,190,322 B2 * 5/2012 Lin ..... G07C 5/008 701/29.1
10,535,207 B1 * 1/2020 Goluguri ..... G07C 5/0841
2010/0274634 A1 * 10/2010 Ifrah ..... H04L 9/3231 705/7.11
2012/0136743 A1 * 5/2012 McQuade ..... G06Q 30/0283 705/26.3
2016/0148442 A1 * 5/2016 Kuemmel ..... G07C 5/008 701/31.4
2017/0352012 A1 * 12/2017 Hearn ..... G06Q 20/3827
2017/0353309 A1 * 12/2017 Gray ..... G06Q 20/3829
2018/0018723 A1 * 1/2018 Nagla ..... G06Q 30/0609
2018/0040040 A1 * 2/2018 Barski ..... G06Q 20/401
2018/0285979 A1 * 10/2018 Chessell ..... G06Q 40/08
(Continued)

FOREIGN PATENT DOCUMENTS

CN 201698229 U 1/2011
DE 10243093 A1 3/2004
WO 2016062216 A1 4/2016

*Primary Examiner* — Richard A Goldman

(57) ABSTRACT

An example operation may include one or more of receiving motor vehicle data related to a motor vehicle from a sensor, retrieving a smart contract, related to the motor vehicle data, stored in a blockchain, performing a validation of the motor vehicle data based on validation standards stored in the smart contract, in response to the validation standards not being satisfied, identifying a required corrective action to the motor vehicle, transmitting a request for the corrective action to be performed to one or more registered entities, receiving a confirmation that the corrective action is complete, creating a blockchain transaction including the confirmation, and storing the blockchain transaction in the blockchain.

20 Claims, 12 Drawing Sheets

(56) References Cited

U.S. PATENT DOCUMENTS

| | | | | |
|---|---|---|---|---|
| 2019/0080402 | A1* | 3/2019 | Molinari | G06Q 40/06 |
| 2019/0149598 | A1* | 5/2019 | Sawada | G05D 1/0297 701/2 |
| 2019/0171744 | A1* | 6/2019 | Ananthapur Bache | H04L 9/3239 |
| 2019/0303463 | A1* | 10/2019 | Catalano | G06F 16/22 |
| 2019/0311437 | A1* | 10/2019 | Sivakumar | G06F 16/27 |
| 2019/0375373 | A1* | 12/2019 | Pepe | B60R 25/246 |
| 2019/0378352 | A1* | 12/2019 | Dey | G07C 5/008 |
| 2019/0378418 | A1* | 12/2019 | Menadue | H04L 9/3239 |
| 2020/0005559 | A1* | 1/2020 | Grunbok, II | H04L 9/0637 |
| 2020/0033887 | A1* | 1/2020 | Kim | G07C 5/0841 |
| 2020/0034457 | A1* | 1/2020 | Brody | G06Q 20/382 |
| 2020/0051068 | A1* | 2/2020 | Love | G06Q 20/367 |
| 2020/0065899 | A1* | 2/2020 | Fritsch | H04L 9/0637 |
| 2020/0081699 | A1* | 3/2020 | Majed | G06F 21/57 |
| 2020/0108840 | A1* | 4/2020 | Andres | G06K 9/00845 |
| 2020/0118131 | A1* | 4/2020 | Diriye | G06Q 20/4016 |
| 2020/0143479 | A1* | 5/2020 | Miyamoto | G06Q 30/0283 |
| 2020/0145225 | A1* | 5/2020 | Faye | H04L 9/3263 |
| 2020/0151806 | A1* | 5/2020 | Kar | H04L 63/105 |

* cited by examiner

200B

500A

500B

500C

600A

600B

VALIDATION OF VEHICLE DATA VIA BLOCKCHAIN

TECHNICAL FIELD

This application generally relates to monitoring and identification of vehicle conditions, and more specifically to performing dynamic monitoring of vehicle conditions in a blockchain.

BACKGROUND

A ledger is commonly defined as an account book of final entry, in which transactions are recorded. Ledgers can be stored on paper or electronically on a computer. A distributed ledger is ledger that is replicated in whole or in part to multiple computers cryptographic distributed ledger (CDL): can have at least some of these properties: irreversibility—once a transaction is recorded, it cannot be reversed accessibility—any party can access the CDL in whole or in part chronological and time-stamped: all parties know when a transaction was added to the ledger consensus based: a transaction is added only if it is approved, typically unanimously, by parties on the network verifiability—all transactions can be cryptographically verified. A blockchain is an example of a CDL. While the description and figures below are described in terms of a blockchain, the instant application applies equally to any CDL.

A distributed ledger is a continuously growing list of records that typically apply cryptographic techniques such as storing cryptographic hashes relating to other blocks. A blockchain is one common instance of a distributed ledger and may be used as a public ledger to store information. Although, primarily used for financial transactions, a blockchain can store various information related to goods and services (i.e., products, packages, status, etc.). A decentralized scheme provides authority and trust to a decentralized network and enables its nodes to continuously and sequentially record their transactions on a public "block", creating a unique "chain" referred to as a blockchain. Cryptography, via hash codes, is used to secure an authentication of a transaction source and removes a central intermediary. Blockchain is a distributed database that maintains a continuously-growing list of records in the blockchain blocks, which are secured from tampering and revision due to their immutable properties. Each block contains a timestamp and a link to a previous block. Blockchain can be used to hold, track, transfer and verify information. Since blockchain is a distributed system, before adding a transaction to the blockchain ledger, all peers need to reach a consensus status.

Periodic emission (pollution) checks of vehicles, such as cars, is a necessity, and in many countries a government regulation. However, all that is normally checked is a single snapshot at a single point of time when a vehicle-owner would bring their vehicle to a vehicle pollution measurement center, and have the vehicle checked to obtain a certification. This process not tamper-proof. For instance, a vehicle in a relatively poor condition, due to age, poor maintenance, and other reasons, may be brought to a service station having had recent fixes in a few basic areas that may produce a temporarily favorable emissions result, while the actual emissions remain poor under normal circumstances. The emissions certification may be received indicating acceptable conditions and the vehicle may still require repairs to maintain the quality sought by the regulating authority. As a result, even if the condition of a particle vehicle is fundamentally poor, the pollution/emission tests can be passed, which is essentially fraud. Such fraud of measurements and reporting can be circumvented given the amount of sensors available in today's vehicles, if those periodic checks were performed without tampering.

SUMMARY

One example embodiment may provide a method that includes at least one of receiving sensory data, storing the sensory data in a blockchain, performing a validation of the sensory data based on validation standards, storing results of the validation in the blockchain, identifying actions and registered entities associated with the actions, and transmitting a request to the registered entities based on the results of the validation and the actions.

Another example embodiment may include an apparatus that includes a processor configured to receive sensory data, store the sensory data in a blockchain, perform a validation of the sensory data based on validation standards, store results of the validation in the blockchain, identify one or more actions and one or more registered entities associated with the one or more actions, and a transmitter configured to transmit a request to the one or more registered entities based on the results of the validation and the one or more actions.

Yet another example embodiment may include a non-transitory computer readable storage medium configured to store instructions that when executed cause a processor to perform receiving sensory data, storing the sensory data in a blockchain, performing a validation of the sensory data based on validation standards, storing results of the validation in the blockchain, identifying one or more actions and one or more registered entities associated with the one or more actions, and transmitting a request to the one or more registered entities based on the results of the validation and the one or more actions.

Yet still another example embodiment provides a method that include one or more of receiving motor vehicle data related to a motor vehicle from a sensor, retrieving a smart contract, related to the motor vehicle data, stored in a blockchain, performing a validation of the motor vehicle data based on validation standards stored in the smart contract, in response to the validation standards not being satisfied, identifying a required corrective action to the motor vehicle, transmitting a request for the corrective action to be performed to one or more registered entities, receiving a confirmation that the corrective action is complete, creating a blockchain transaction comprising the confirmation, and storing the blockchain transaction in the blockchain.

Yet still another example embodiment includes a system that includes a motor vehicle, a computing entity configured to receive motor vehicle data related to the motor vehicle from a sensor, retrieve a smart contract, related to the motor vehicle data, stored in a blockchain, perform a validation of the motor vehicle data based on validation standards stored in the smart contract, in response to the validation standards not being satisfied, identify a required corrective action to the motor vehicle, and one or more registered entities configured to receive a request for the corrective action to be performed, and the computing entity is configured to receive a confirmation that the corrective action is complete, create a blockchain transaction comprising the confirmation, and store the blockchain transaction in the blockchain.

Yet still another example embodiment may include a non-transitory computer readable storage medium configured to store instructions that when executed cause a processor to perform receiving motor vehicle data related to a motor vehicle from a sensor, retrieving a smart contract, related to the motor vehicle data, stored in a blockchain, performing a validation of the motor vehicle data based on validation standards stored in the smart contract, in response to the validation standards not being satisfied, identifying a required corrective action to the motor vehicle, transmitting a request for the corrective action to be performed to one or more registered entities, receiving a confirmation that the corrective action is complete, creating a blockchain transaction comprising the confirmation, and storing the blockchain transaction in the blockchain.

DETAILED DESCRIPTION

Figure 1A:
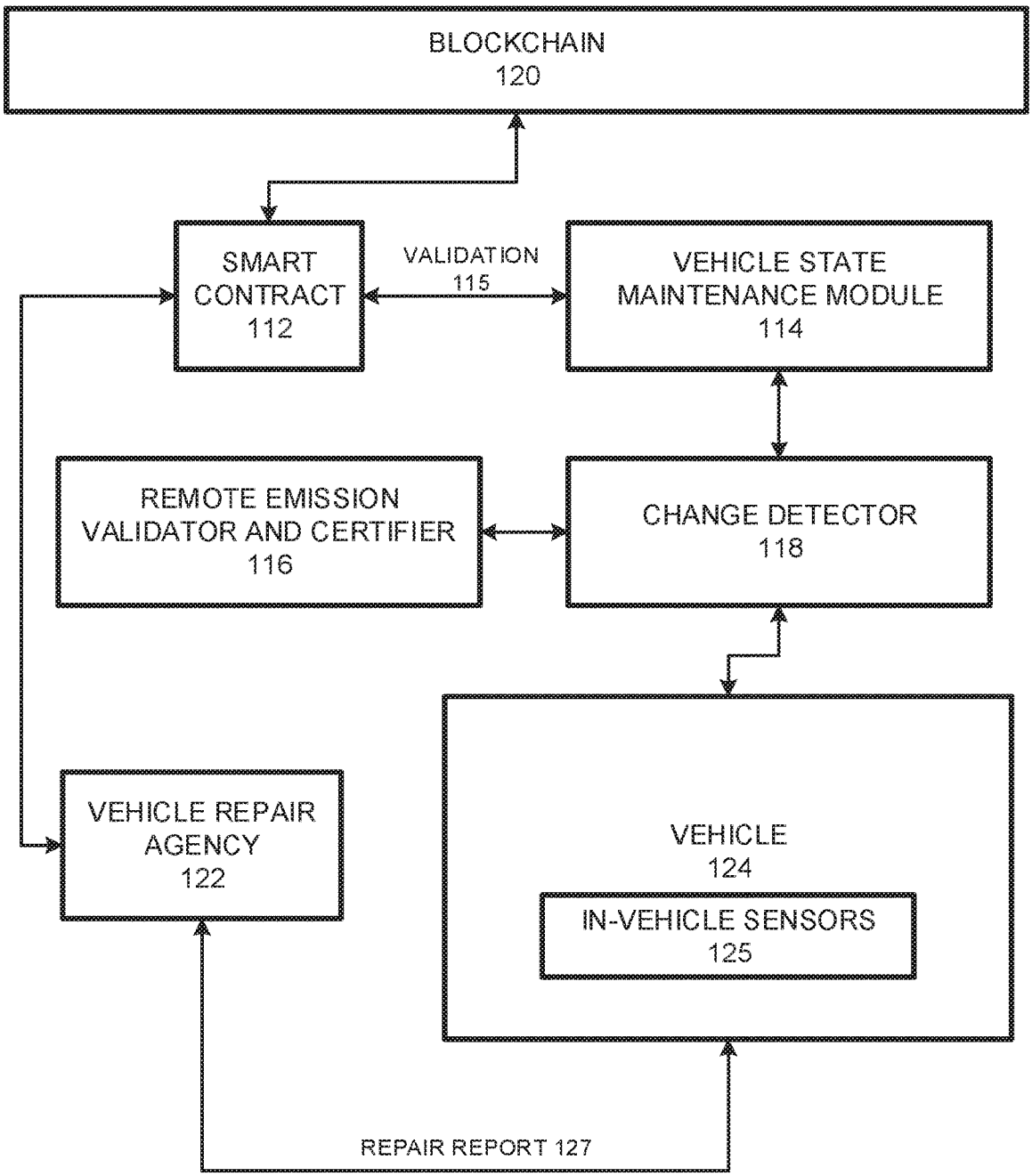
FIG. 1A illustrates a logic diagram of a vehicle maintenance management record using a blockchain configuration, according to example embodiments.

It will be readily understood that the instant components, as generally described and illustrated in the figures herein, may be arranged and designed in a wide variety of different configurations. Thus, the detailed description of the embodiments of at least one of a method, an apparatus, a non-transitory computer readable medium and a system, as represented in the associated figures and description, is not intended to limit the scope of the application, but is merely representative of selected embodiments.

The instant features, structures, or characteristics as described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

In addition, while the term "message" may have been used in the description of embodiments, the application may be applied to many types of messages or network data, such as, packet, frame, datagram, etc. Furthermore, while certain types of messages, signaling and protocols may be depicted in exemplary embodiments they are not limited to a certain type of message, signaling or protocol.

Example embodiments provide methods, devices, networks and/or systems, which support a blockchain distributed system with selective peer management procedures. A blockchain is a distributed system which includes multiple nodes that communicate with each other. A blockchain operates programs called chaincode (e.g., smart contracts, etc.), holds state and ledger data, and executes transactions. Some transactions are operations invoked on the chaincode. In general, blockchain transactions typically must be "endorsed" by certain blockchain members and only endorsed transactions may be committed to the blockhcain and have an effect on the state of the blockchain. Other transactions which are not endorsed are disregarded. There may exist one or more special chaincodes for management functions and parameters, collectively called system chaincodes.

Nodes are the communication entities of the blockchain system. A "node" may perform a logical function in the sense that multiple nodes of different types can run on the same physical server. Nodes are grouped in trust domains and are associated with logical entities that control them in various ways. Nodes may include different types, such as a client or submitting-client node which submits a transaction-invocation to an endorser (e.g., peer), and broadcasts transaction-proposals to an ordering service (e.g., ordering node). Another type of node is a peer node which can receive client submitted transactions, commit the transactions and maintain a state and a copy of the ledger of blockchain transactions. Peers can also have the role of an endorser, although it is not a requirement. An ordering-service-node or orderer is a node running the communication service for all nodes, and which implements a delivery guarantee, such as a broadcast to each of the peer nodes in the system when committing transactions and modifying a world state of the blockchain, which is another name for the initial blockchain transaction which normally includes control and setup information.

A ledger is a sequenced, tamper-resistant record of all state transitions of a blockchain. State transitions may result from chaincode invocations (i.e., transactions) submitted by participating parties (e.g., client nodes, ordering nodes, endorser nodes, peer nodes, etc.). A transaction may result in a set of asset key-value pairs being committed to the ledger as one or more operands, such as creates, updates, deletes, and the like. The ledger includes a blockchain (also referred to as a chain) which is used to store an immutable, sequenced record in blocks. The ledger also includes a state database which maintains a current state of the blockchain.

There is typically one ledger per channel. Each peer node maintains a copy of the ledger for each channel of which they are a member.

A chain is a transaction log which is structured as hash-linked blocks, and each block contains a sequence of N transactions where N is equal to or greater than one. The block header includes a hash of the block's transactions, as well as a hash of the prior block's header. In this way, all transactions on the ledger may be sequenced and cryptographically linked together. Accordingly, it is not possible to tamper with the ledger data without breaking the hash links. A hash of a most recently added blockchain block represents every transaction on the chain that has come before it, making it possible to ensure that all peer nodes are in a consistent and trusted state. The chain may be stored on a peer node file system (i.e., local, attached storage, cloud, etc.), efficiently supporting the append-only nature of the blockchain workload.

The current state of the immutable ledger represents the latest values for all keys that are included in the chain transaction log. Because the current state represents the latest key values known to a channel, it is sometimes referred to as a world state. Chaincode invocations execute transactions against the current state data of the ledger. To make these chaincode interactions efficient, the latest values of the keys may be stored in a state database. The state database may be simply an indexed view into the chain's transaction log, it can therefore be regenerated from the chain at any time. The state database may automatically be recovered (or generated if needed) upon peer node startup, and before transactions are accepted.

Example embodiments provide a method, device, computer readable medium, and system for tracking performance indicators of a vehicle. In operation, sensors disposed on the vehicle may identify event information, such as routine checks for temperature, excessive characteristics (i.e., temperature, noise, pollution, movement, etc.) and automatically share event information used to create and report a vehicle condition report/chart. In one specific example, vehicle emissions/pollution will be monitored in an ongoing basis and interested parties may access the information from a blockchain where the information is securely stored in an immutable information source. Examples of interested parties may include local and state-wide government agencies, vehicle registration parties, manufacturers/sellers of the vehicle, and/or registered/preferred vehicle fixing/maintenance agencies.

The blockchain may store smart service contracts which enable other parties to work with the vehicle owner to resolve/fix the current vehicle deficiencies. For example, by enabling others to contract and fix certain items which translate to parameters of the vehicle's health, between the vehicle owner and a chosen/pre-registered/preferred fixing agency, when such damage is detected, a resolution to the vehicle's requirements and compliance may be rendered.

Some vehicle problems may be fixed over-the-air, such as auto-reprogramming of vehicle software to optimize engine and transmission performance and to stay abreast with changes in manufacturer standards. For example, if a manufacturer posts a software update required for certain makes and models, the vehicle may use a wireless communication medium to access, identify the update and download and install the update to optimize corrective measures. A third party vehicle service may provide such a service based on vehicle registration with the service. All the updates, past and present, may be stored in a vehicle profile in the blockchain.

In one example, if one or more vehicle correction agencies deem the vehicle to be irreparable then a report of the irreparability, including the vehicle/owner identity, time stamp and the reason/tests/attempts-to-repair conducted by the agency, may be included in the report which is stored in the blockchain. Government agencies and other interested parties may access the blockchain to retrieve and/or maintain a record of the vehicle, those corrective measures which have been taken, and any other information, and citing the details and the agency identity as part of the record.

FIG. 1A illustrates a logic diagram of a vehicle maintenance management record using a blockchain configuration, according to example embodiments. Referring to FIG. 1A, the configuration 100 includes a blockchain 120, which may be written to and read from in order to identify and maintain vehicle records. The blockchain 120 may provide a smart contract 112 which may include terms and conditions for a vehicle repair agency 122 to make any needed repairs to a vehicle 124. In operation, in-vehicle sensors 125 provide information regarding vehicle status, needed repairs, etc., to a change detector module 118. The module may process the information and determine whether the sensor data indicates a repair is needed. A vehicle state maintenance module 114 and remote emission validator and certifier 116 may communicate with the vehicle change detector 118 to identify whether the repairs are needed, have been made and whether a validation 115 has occurred, such as a report or other certification. The agency making the repairs 122 may provide a repair report 127 once the validation has been made. The updated information may be stored in the blockchain 120.

The blockchain 120 will be accessed for vehicle history validation, such as while auditing, selling/buying activities related to the vehicle, etc., as well as for event recording and smart contract execution. In this configuration, the smart contract will execute when a validation-fail is detected. As a result, a request to fix message is created and sent to a repairing agency for a vehicle information and/or a customer preference. The repairing agency, in turn, may perform the necessary repairs, which are agreed upon by all the parties, such as the vehicle owner, repairing agency, and any other party in the transaction, such as an insurance entity, government entity, legal entity, etc. A notation and transaction may be created to indicate that the repair succeeded/failed. The consensus of the parties is recoded in the blockchain as an updated transaction. This situation could also include an agreement of the re-tuning of the vehicle parameters to be performed.

Further to the vehicle repair status update example, a unique ID may be generated for a vehicle after its purchase and assignment to a new owner, this information is submitted to the blockchain as an initial transaction record for the vehicle. One or more car repair/maintenance agencies may be subsequently selected using an external assignment application to repair any detected conditions or events associated with the vehicle. The seller, buyer and the external repair/maintenance agencies may all be parties to the consensus, as blockchain members, which are necessary to commit the transaction as part of the vehicle history stored in the blockchain.

In the process of monitoring the vehicle's operational status, for each part of the car that is being monitored via sensors, the sensors may be enabled and compatible with IoT-enabled computing and with sensing modules that are capable of identifying and broadcasting information in the event of a detected condition. The sensors may be connected to or contained in self-health checking modules on one or more parts of the vehicle. The unique ID can be created by computing a hash function that is based on each vehicle part ID associated with the parts of the vehicle being monitored. The multiple IoT-enabled sensors/computational modules are fitted in the vehicle and are capable of communicating with each other to share information. The overall health of the vehicle is computed as a function of all the local health conditions of the parts of the vehicle participating in the monitoring application functions. Positive or negative changes in the vehicle status of any one part of the vehicle can favorably or adversely affect the health of another part, and the overall health status of the vehicle. For example, if the cylinders of the engine have an issue, then the performance of the piston may be affected, since the two work together. For those reasons, sensors using IoT compatibility communicate with each other, and with third-party validation servers run by vehicle management authorities, to obtain and immutably record consensus on the overall health status of a vehicle on a continuous basis. This may generate globally identifiable entries which include a unique ID for each of the health check events identifier/performed, and which occur at each detected point of "change". Since multiple parties such as vehicle selling agencies, government, insurance providers, parts suppliers and local maintenance agencies are involved in the process, then those parties may desire to be updated with the current status of the vehicle. The distributed/decentralized system of the blockchain provides ongoing monitoring, updates and action status information which may be required.

Figure 1B:
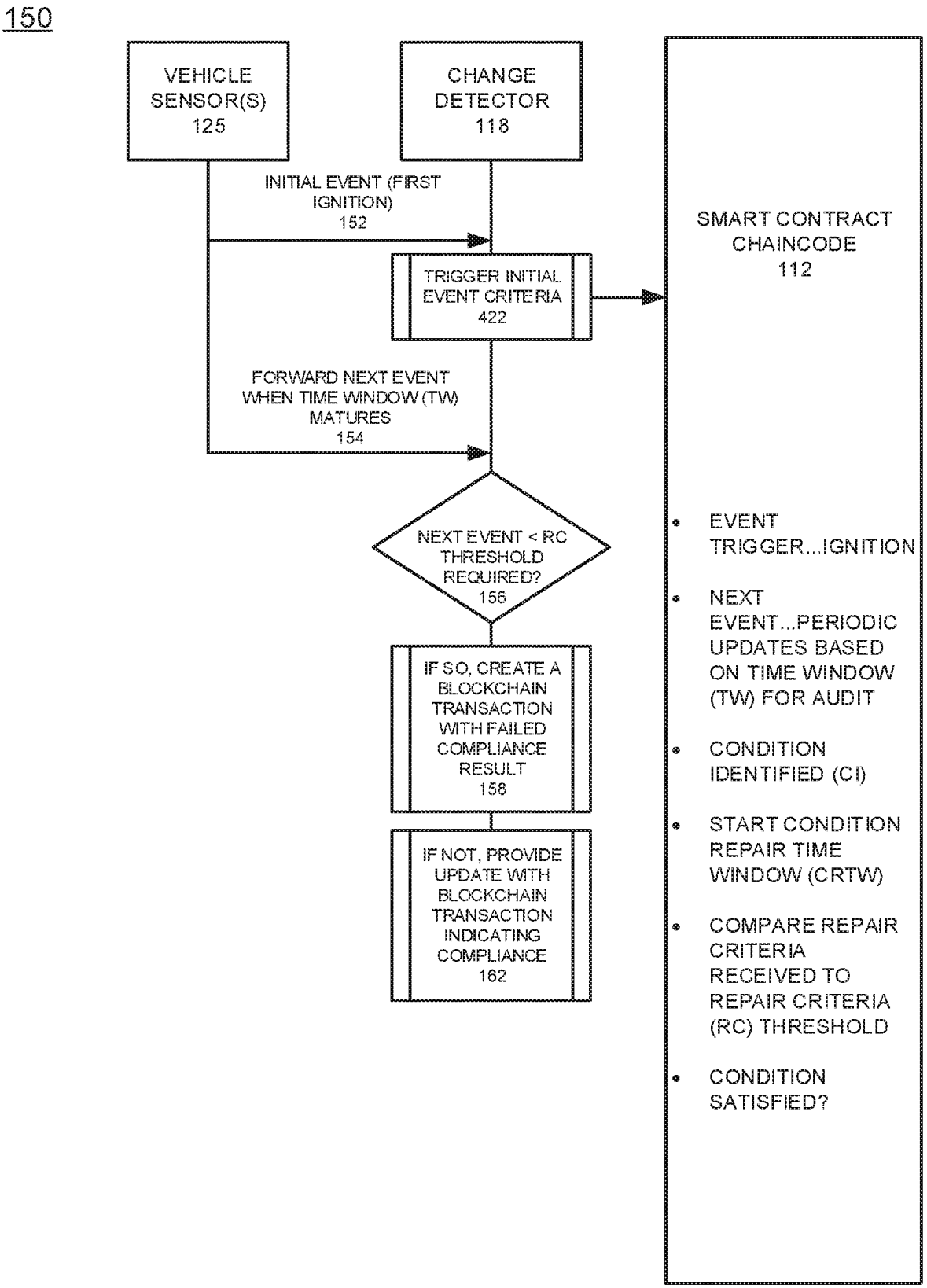
FIG. 1B illustrates a system diagram of vehicle sensors operating with a change detector based on smart contract requirements, according to example embodiments.

FIG. 1B illustrates a system diagram of vehicle sensors operating with a change detector based on smart contract requirements, according to example embodiments. Referring to FIG. 1B, the system 150 includes a set of vehicle installed sensors 125, a change detector computing/logic entity 118 that represents a computer and/or an application that executes the sensor data and chaincode operations, and a smart contract 112. In one example, for each event of "change" and a corresponding blockchain transaction recording, such as the initial event 152 of turning on the vehicle, the smart contract 112 is accessed for requirements and operations which may be performed based on those triggers. The trigger in this example may be to identify initial event criteria 422, such as a certain threshold exhaust requirement, temperature requirements, etc. The sensor-read data (e.g., identifiable records) are captured by the sensors 125 and forwarded to the change detector 118 which references the smart contract 112 for a comparison, analysis and other logic operations included in the smart contract. The overall vehicle health conditions may be inferred and passed onto the smart contract. If the pre-set conditions required a repair and/or if external policies, which can even be newly assigned levels of permissible vehicle health based on changes to policies, then the smart contract 112 is executed, between the repairing agency and the owner of the vehicle. In some cases, the vehicle could be on a lease, and that information is also recorded as a blockchain transaction. Every time a car is leased, a unique ID is generated and is recorded on the blockchain. In this case, both the main owner and the current borrower of the car are made parties to a side-smart contract, which then becomes necessary to execute before the main smart contract can execute. The chaincode may reference the side-smart contract until the contract expires. This approach makes it a multi-layer smart contract for vehicle renting, and maintaining vehicle health while the vehicle is leased.

In another example, when multiple suppliers are required to assemble one part. In such cases, the smart contract is executed between all the suppliers supplying the different parts, and the other interested parties (e.g., owner, insurance provider, government assigned to the vehicle, etc.). The smart contract 112 would be executed as a multi-layer smart contract, so the maintenance agency and the supplier of each sub-part will execute one layer, and the maintenance agency, car owner, insurance and so on will execute the other layer of the smart contract chaincode. As a result, whenever a part is replaced in the vehicle with a new part, the record is written on the blockchain and a consensus is established. If at any time, the government/regulating agency is attempting to reduce the accessibility of certain vehicles on the road, based on a new policy or law passed for emissions, then it should be able to fetch the health status of all the vehicles and assign the failing ones to be removed from the road usage if they do not qualify under the new policy, and failure to abide may result in fines, which can be policed by sensor data and thus do not require a police agent to catch the driver in the act of operating a disqualified vehicle. In this instance, when the vehicle is assigned to be taken-off the road, the transaction is also recorded on the blockchain. In another example, the subsequent monitoring of events 154 are performed again when a certain time window (TW) matures (e.g., six months). In the event that the capture event is below a repair criteria threshold 156, such as the engine is too hot, the emissions are measured to be excessive, etc., the event creates a new transaction indicating the event 158 and as specific by the smart contract, the violated condition. Or, if the condition is not violated, then the updated blockchain transaction may reflect the continued compliance of the vehicle and not action is required at that time.

Figure 2A:
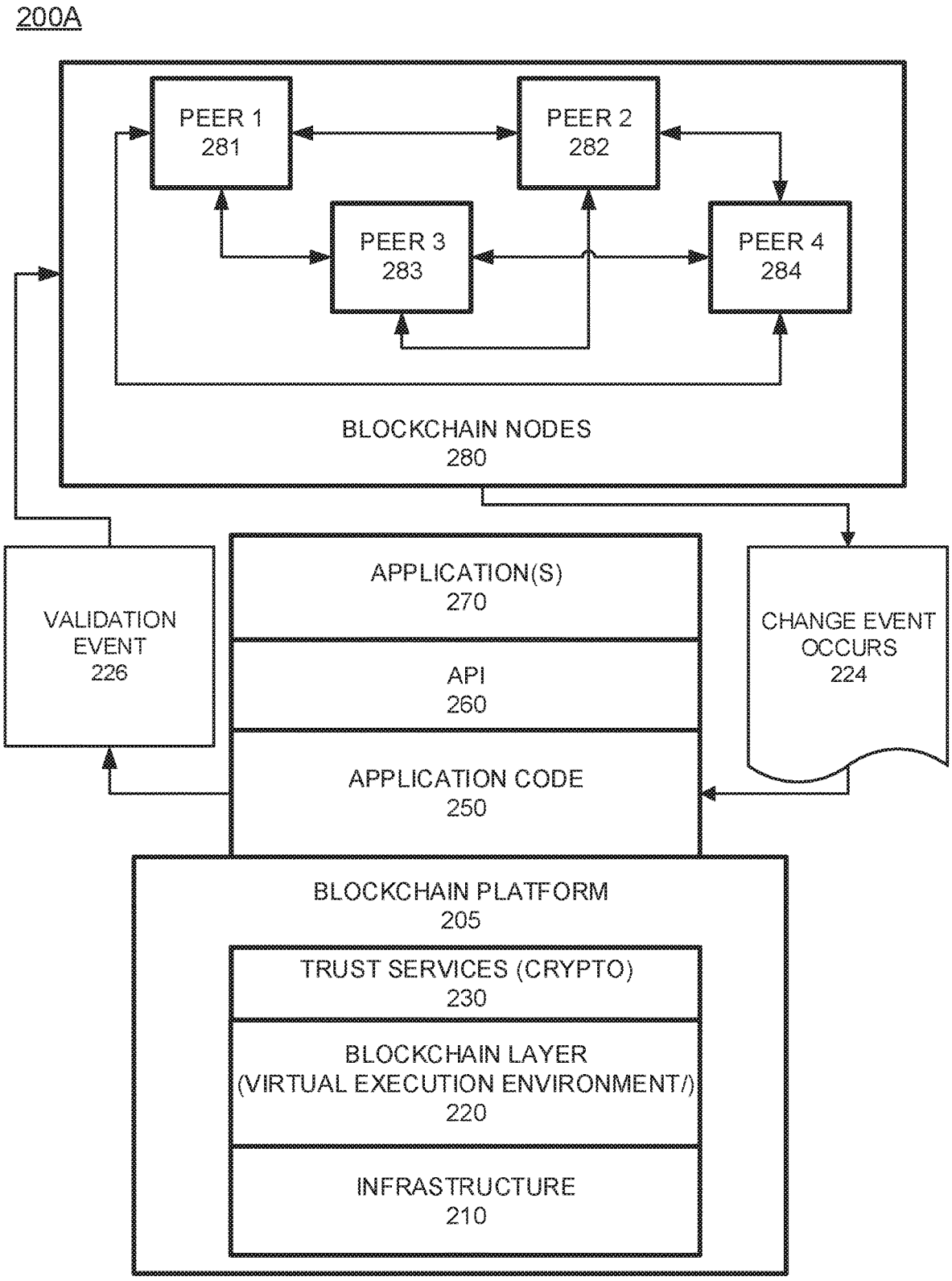
FIG. 2A illustrates an example vehicle maintenance blockchain architecture, according to example embodiments.

FIG. 2A illustrates a blockchain system architecture configuration 200A, according to example embodiments. Referring to FIG. 2A, blockchain architecture 200A may include certain blockchain elements, for example, a group 280 of blockchain nodes 281-284 which participate in blockchain transaction addition and validation process (consensus). One or more of the blockchain nodes 281-284 may endorse transactions and one or more blockchain nodes 281-284 may provide an ordering service for all blockchain nodes in the architecture 200A. A blockchain node may initiate a blockchain authentication and attempt to write to a blockchain immutable ledger stored in blockchain layer 220, a copy of which may also be stored on the underpinning physical infrastructure 210. The blockchain configuration may include one or more applications 270, which are linked to application programming interfaces (APIs) 260 to access and execute stored program/application code 250 (e.g., chaincode, smart contracts, etc.), which can be created according to a customized configuration sought by participants and can maintain their own state, control their own assets, and receive external information.

The blockchain base or platform 205 may include various layers of blockchain data, services (e.g., cryptographic trust services, virtual execution environment, etc.), and underpinning physical computer infrastructure that may be used to receive and store new transactions and provide access to auditors which are seeking to access data entries. The blockchain layer 220 may expose an interface that provides access to the virtual execution environment necessary to process the program code and engage the physical infrastructure 210. Cryptographic trust services 230 may be used to verify transactions such as asset exchange transactions and keep information private.

The blockchain architecture configuration of FIG. 2A may process and execute program/application code 250 via one or more interfaces exposed, and services provided, by blockchain platform 205. The code 250 may control blockchain assets. For example, the code 250 can store and transfer data, and may be executed by nodes 281-284 in the form of a smart contract and associated chaincode with conditions or other code elements subject to its execution. As a non-limiting example, smart contracts may be created to execute reminders, updates, and/or other notifications subject to the changes, updates, etc. The smart contracts can themselves be used to identify rules associated with authorization and access requirements and usage of the ledger. In one example, when sensor data causes certain change events to occur 224, the events may be logged, forwarded and processed by third parties to identify the vehicle maintenance needs. Once the validation has occurred, a validation event certificate or validation document 226 may be identified and stored in the blockchain.

Within chaincode, a smart contract may be created via a high-level application and programming language, and then written to a block in the blockchain. The smart contract may include executable code which is registered, stored, and/or replicated with a blockchain (e.g., distributed network of blockchain peers). A transaction is an execution of the smart contract code which can be performed in response to conditions associated with the smart contract being satisfied. The executing of the smart contract may trigger a trusted modification(s) to a state of a digital blockchain ledger. The modification(s) to the blockchain ledger caused by the smart contract execution may be automatically replicated throughout the distributed network of blockchain peers through one or more consensus protocols.

The smart contract may write data to the blockchain in the format of key-value pairs. Furthermore, the smart contract code can read the values stored in a blockchain and use them in application operations. The smart contract code can write the output of various logic operations into the blockchain. The code may be used to create a temporary data structure in a virtual machine or other computing platform. Data written to the blockchain can be public and/or can be encrypted and maintained as private. The temporary data that is used/generated by the smart contract is held in memory by the supplied execution environment, then deleted once the data needed for the blockchain is identified.

A chaincode may include the code interpretation of a smart contract, with additional features. As described herein, the chaincode may be program code deployed on a computing network, where it is executed and validated by chain validators together during a consensus process. In operation, the chaincode may receive a hash and retrieve from the blockchain a hash associated with the data template created by a previously stored feature extractor. If the hashes of the hash identifier and the hash created from the stored identifier template data match, then the chaincode sends an authorization key to the requested service. The chaincode may write to the blockchain data associated with the cryptographic details.

Figure 2B:
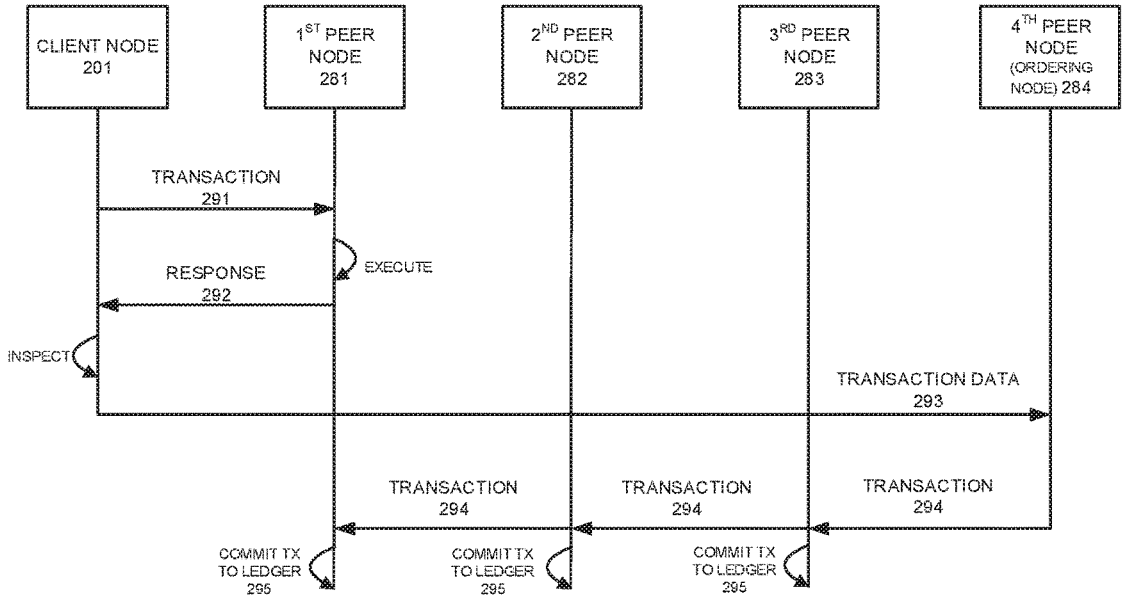
FIG. 2B illustrates an example peer node blockchain configuration, according to example embodiments.

FIG. 2B illustrates an example of a transactional flow 200B between nodes of the blockchain in accordance with an example embodiment. Referring to FIG. 2B, the transaction flow may include a transaction proposal 291 sent by an application client node 201 to an endorsing peer node 281. The endorsing peer 281 may verify the client signature, and execute a chaincode function to simulate the transaction. The output may include the chaincode results, a set of key/value versions that were read in the chaincode (read set), and the set of keys/values that were written in chaincode (write set). The proposal response 292 is sent back to the client 201 along with an endorsement signature, if approved. The client 201 assembles the endorsements into a transaction payload 293 and broadcasts it to an ordering service node 284. The ordering service node 284 then delivers ordered transactions as blocks to all peers 281-283 on a channel. Before committal to the blockchain, each peer 281-283 may validate the transaction. For example, the peers may check the endorsement policy to ensure that the correct allotment of the specified peers have signed the results, and authenticated the signatures against the transaction payload 293.

Referring again to FIG. 2B, the client node 201 initiates the transaction 291 by constructing and sending a request to the peer node 281, which is an endorser. The client 201 may include an application leveraging a supported software development kit (SDK), such as NODE, JAVA, PYTHON, and the like, which utilizes an available API to generate a transaction proposal. The proposal is a request to invoke a chaincode function so that data can be read and/or written to the ledger (i.e., write new key value pairs for the assets). The SDK may serve as a shim to package the transaction proposal into a properly architected format (e.g., protocol buffer over a remote procedure call (RPC)) and take the client's cryptographic credentials to produce a unique signature for the transaction proposal.

In response, the endorsing peer node 281 may verify (a) that the transaction proposal is well formed, (b) the transaction has not been submitted already in the past (replay-attack protection), (c) the signature is valid, and (d) that the submitter (client 201, in the example) is properly authorized to perform the proposed operation on that channel. The endorsing peer node 281 may take the transaction proposal inputs as arguments to the invoked chaincode function. The chaincode is then executed against a current state database to produce transaction results including a response value, read set, and write set. However, no updates are made to the ledger at this point. In 292, the set of values, along with the endorsing peer node's 281 signature is passed back as a proposal response 292 to the SDK of the client 201 which parses the payload for the application to consume.

In response, the application of the client 201 inspects/verifies the endorsing peers signatures and compares the proposal responses to determine if the proposal response is the same. If the chaincode only queried the ledger, the application would inspect the query response and would typically not submit the transaction to the ordering node service 284. If the client application intends to submit the transaction to the ordering node service 284 to update the ledger, the application determines if the specified endorsement policy has been fulfilled before submitting (i.e., did all peer nodes necessary for the transaction endorse the transaction). Here, the client may include only one of multiple parties to the transaction. In this case, each client may have their own endorsing node, and each endorsing node will need to endorse the transaction. The architecture is such that even if an application selects not to inspect responses or otherwise forwards an unendorsed transaction, the endorsement policy will still be enforced by peers and upheld at the commit validation phase.

After successful inspection, in step 293 the client 201 assembles endorsements into a transaction and broadcasts the transaction proposal and response within a transaction message to the ordering node 284. The transaction may contain the read/write sets, the endorsing peers signatures and a channel ID. The ordering node 284 does not need to inspect the entire content of a transaction in order to perform its operation, instead the ordering node 284 may simply receive transactions from all channels in the network, order them chronologically by channel, and create blocks of transactions per channel.

The blocks of the transaction are delivered from the ordering node 284 to all peer nodes 281-283 on the channel. The transactions 294 within the block are validated to ensure any endorsement policy is fulfilled and to ensure that there have been no changes to ledger state for read set variables since the read set was generated by the transaction execution. Transactions in the block are tagged as being valid or invalid. Furthermore, in step 295 each peer node 281-283 appends the block to the channel's chain, and for each valid transaction the write sets are committed to current state database. An event is emitted, to notify the client application that the transaction (invocation) has been immutably appended to the chain, as well as to notify whether the transaction was validated or invalidated.

Figure 3:
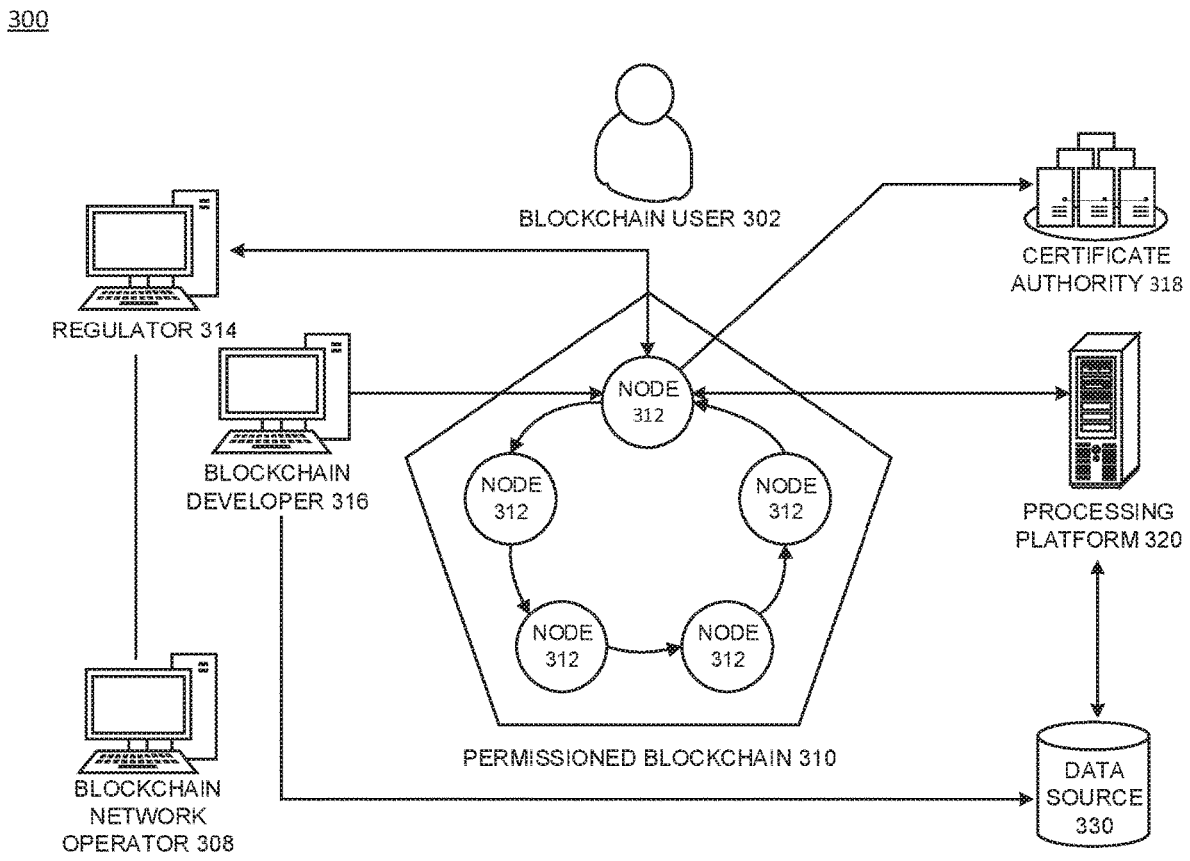
FIG. 3 is a diagram illustrating a permissioned blockchain network, according to example embodiments.

FIG. 3 illustrates an example of a permissioned blockchain network 300, which features a distributed, decentralized peer-to-peer architecture, and a certificate authority 318 managing user roles and permissions. In this example, the blockchain user 302 may submit a transaction to the permissioned blockchain network 310. In this example, the transaction can be a deploy, invoke or query, and may be issued through a client-side application leveraging an SDK, directly through a REST API, or the like. Trusted business networks may provide access to regulator systems 314, such as auditors (the Securities and Exchange Commission in a U.S. equities market, for example). Meanwhile, a blockchain network operator node 308 manages member permissions, such as enrolling the regulator system 310 as an "auditor" and the blockchain user 302 as a "client." An auditor could be restricted only to querying the ledger whereas a client could be authorized to deploy, invoke, and query certain types of chaincode.

A blockchain developer system 316 writes chaincode and client-side applications. The blockchain developer system 316 can deploy chaincode directly to the network through a REST interface. To include credentials from a traditional data source 330 in chaincode, the developer system 316 could use an out-of-band connection to access the data. In this example, the blockchain user 302 connects to the network through a peer node 312. Before proceeding with any transactions, the peer node 312 retrieves the user's enrollment and transaction certificates from the certificate authority 318. In some cases, blockchain users must possess these digital certificates in order to transact on the permissioned blockchain network 310. Meanwhile, a user attempting to drive chaincode may be required to verify their credentials on the traditional data source 330. To confirm the user's authorization, chaincode can use an out-of-band connection to this data through a traditional processing platform 320.

Figure 4:
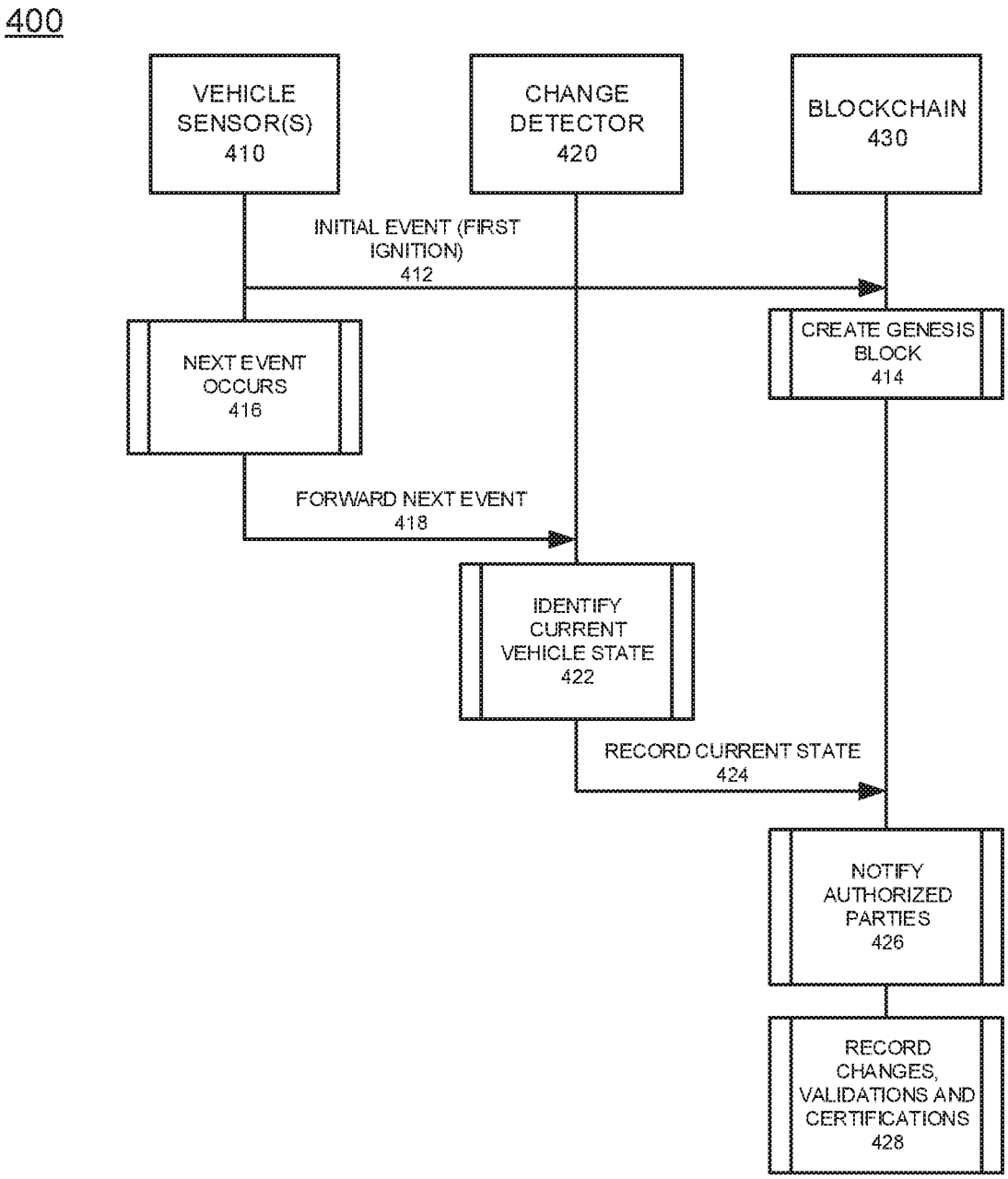
FIG. 4 illustrates a system messaging diagram for managing vehicle maintenance in a blockchain, according to example embodiments.

FIG. 4 illustrates a system messaging diagram for managing vehicle maintenance in a blockchain, according to example embodiments. Referring to FIG. 4, the configuration 400 includes a vehicle sensor 410 which provides event data to a change detector 420, such as a processing module of a computer located in the vehicle and/or a remote site, and a blockchain 430. During an initial setup procedure, such as the first time the vehicle is powered-on, the initial event 412 may be logged in the blockchain to write to the genesis block 414 so the vehicle is registered for future reference. The next event that occurs 416, such as routine monitoring performed by an on-board sensor, may be identified, recorded and forwarded 418 to the change detector 420 for processing. The processing may yield that a current vehicle state 422 has changed and requires maintenance or other measures. The current state is recorded 424 and the necessary parties are notified 426 for certification, repairs, regulations, etc. Any changes made to the vehicle along with updated reports, etc., are recorded 428 in the blockchain 430.

In further detail, when a genesis block is written at the beginning of the lifecycle of the vehicle, preferably the first time the vehicle ignition is turned on at the manufacturer's site, or at the time of sale using an explicit indication sent via a control signal to the vehicle over-the-air, a "change" event is detected. Examples of change events include but are not limited to: a vehicle being turned on after a prolonged period of remaining turned off, such as, turned on next morning after getting turned off a previous night, a vehicle enters a zone with a significantly different temperature, or, over a given time duration, the rate of change of temperature, or the max or min absolute temperature, has been high for a finite time duration after such change is detected, sudden changes in weather conditions for a finite time duration, the vehicle air condition (AC) is turned on/off for a finite time duration after such a turn on/off. The accelerator of the vehicle is pressed, or has remained pressed at/beyond a pressure limit for a set time duration, a certain revolution rate of the vehicle engine is attained, a random duration after the vehicle has been turned on/off, a random sampling is obtained for any other reason, etc. Each time a "change" event is detected, a current state of the vehicle operational parameters is inspected and recorded in a block (i.e., vehicle turned on/off, accelerometer pressed a certain amount, AC status, engine revolution rate, etc.) along with a timestamp of the time and date, and the detected emissions, which may be detected by a built-in vehicle sensor(s).

A validation event is performed by a remote server, which may be authorized by certain agencies, such as the local government or other authorized entities, by sending the current emission data and obtaining valid results, which are then recorded in the blockchain as a validation report. In case the validation fails, a request-to-fix event is sent out to one or more pre-registered vehicle maintenance agencies that the vehicle is registered with, and a smart contract for the current fixing effort is executed between the vehicle owner and the agency selected by the vehicle-owner, such as, by preset policies identified by the customer's order of preference, lowest pricing, etc. The agency may now attempt to fix/certify the vehicle, in one example, the fixing/correction/certification is performed over-the-air by updating one or more of the tuning parameters of the vehicle over a wireless communication link, which is stored in the vehicle computer system. Otherwise, the vehicle may need to visit a local automotive center for physical alteration.

The fixing agency details, including what was fixed, the date/time the fix was performed, etc., are recoded at in a block of the blockchain. Further, the parameters after the fixing operation are recorded along with the emissions data observed post-fixing to demonstrate compliance standards. The state maintenance module may identify that the vehicle was expected to be repaired and has been repaired, and a validation event may be generated at a remote server for the current emissions test. If the test was recorded satisfactorily, the fixing agency is updated accordingly, and the satisfactory results are written into a block. If recorded in a non-satisfactory status, then a re-tuning process may be performed by an agency on the vehicle, up to a threshold number of times, and the parameters that could not be fixed are marked in the block for audit purposes. If the recorded data is still non-satisfactory after a sufficient number of re-tunings, then the vehicle is deemed irreparable by the agency, and an update to the expected remaining life span of the vehicle is recorded, which cites the irreparability details and the agency identity as part of the record. If a large enough number of authorized agencies mark the vehicle as irreparable, then processes may trigger for further official inspections, such as government inspections of the vehicle lifespan, or the vehicle may be deemed non-operational as indicated by a policy, which is also recorded and may cause the owner to abandon the vehicle or prevent a sale to knowledgeable parties.

Figure 5A:
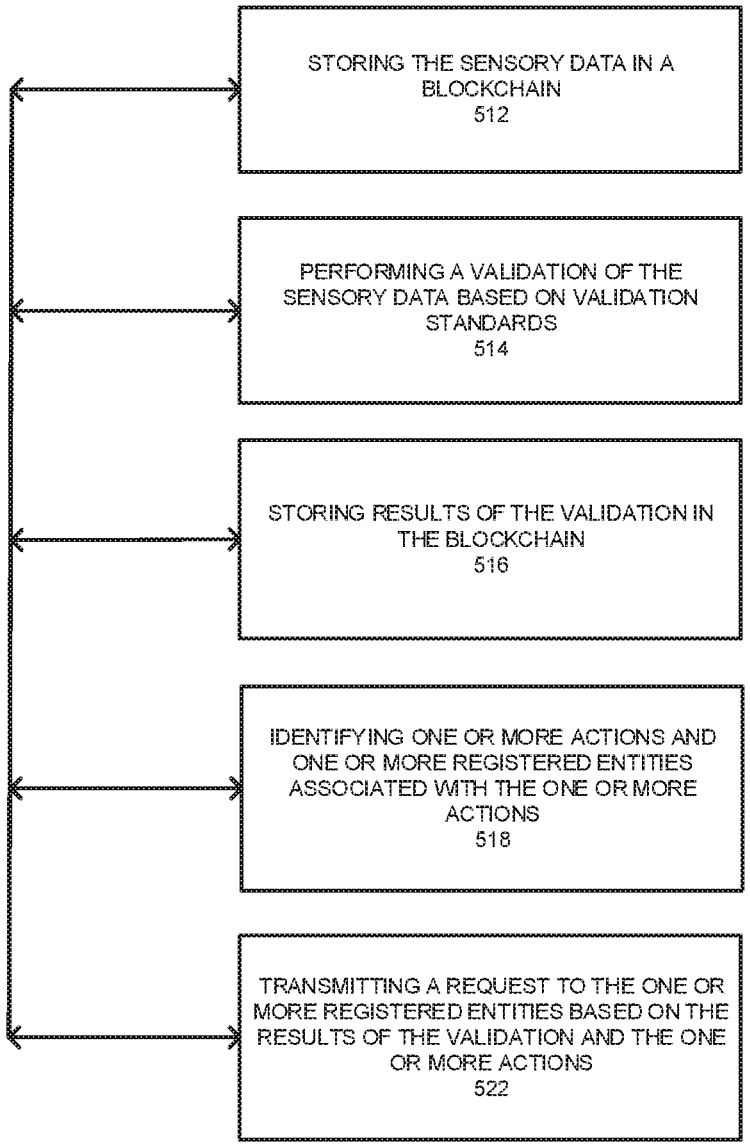
FIG. 5A illustrates a flow diagram of an example method of managing vehicle maintenance in a blockchain, according to example embodiments.

FIG. 5A illustrates a flow diagram of an example method of managing vehicle maintenance in a blockchain, according to example embodiments. Referring to FIG. 5A, the method 500A may include receiving the sensory data and storing the sensory data in a blockchain 512, performing a validation of the sensory data based on validation standards 514, by comparing the event data linked to the sensory information to known thresholds for testing purposes, such as levels, temperatures, or other figures or numbers. The method may also include storing results of the validation in the blockchain 516, identifying one or more actions and one or more registered entities associated with the one or more actions 518, and transmitting a request to the one or more registered entities based on the results of the validation and the one or more actions 522.

The method may also include creating a genesis block for the blockchain responsive to an initial motor vehicle event having occurred, and wherein the sensory data is associated with a motor vehicle, and retrieving a smart contract stored in the blockchain to identify terms and conditions for how to manage the events, parties to contact, rules, owner preferences, etc. The initial vehicle event is one or more of a change in vehicle operating conditions, as determined by one or more on-board vehicle sensors, and an initial vehicle startup operation. The method may also include receiving an updated status from the one or more registered entities regarding a change in status of the motor vehicle, and storing the updated status in the blockchain. The updated status includes motor vehicle repair data, dates, and certification data associated with the one or more registered entities. The one or more actions include one or more motor vehicle repairs. The method may also include receiving a validation report from a third party agency, responsive to the updated status being received and approved by the third party agency, and storing the validation report in the blockchain.

Figure 5B:
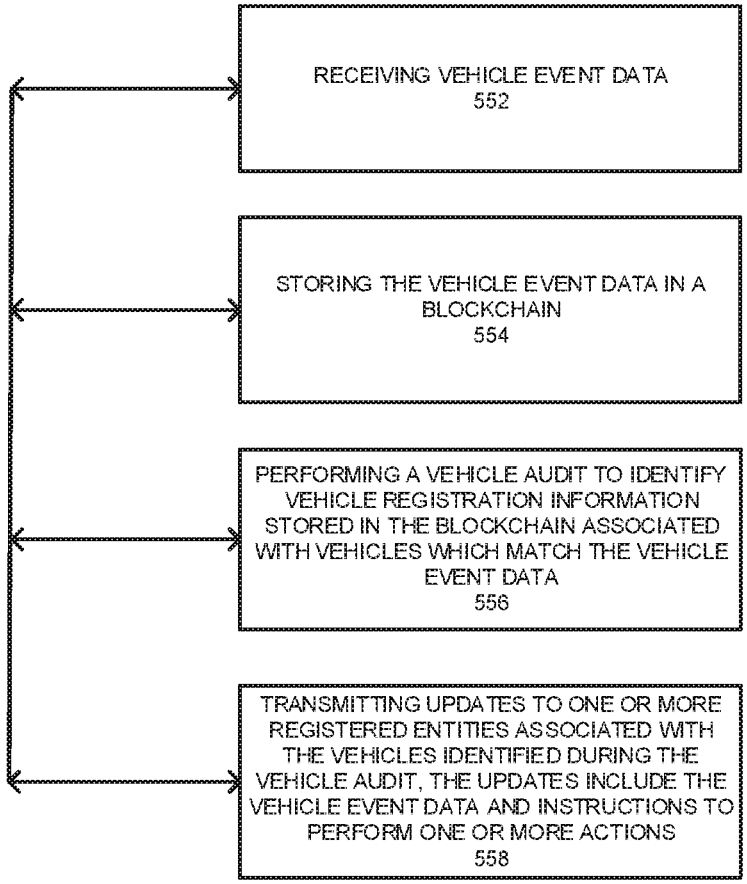
FIG. 5B illustrates a flow diagram of another example method of managing vehicle maintenance in a blockchain, according to example embodiments.

FIG. 5B illustrates a flow diagram of another example method of managing vehicle maintenance in a blockchain, according to example embodiments. Referring to FIG. 5B, the method 500B may include receiving vehicle event data 552, storing the vehicle event data in a blockchain 554, performing a vehicle audit to identify vehicle registration information stored in the blockchain associated with vehicles which match the vehicle event data 556, and transmitting updates to one or more registered entities associated with the vehicles identified during the vehicle audit, the updates include the vehicle event data and instructions to perform one or more actions 558.

In addition to just monitoring vehicles for sensory data, when important information is identified from the registered interested parties, such as a vehicle recall or other important event, the event data may be compared to the blockchain entries to identify those vehicles which match the make and model or the relevant information needed to identify the potential vehicles requiring notification. The registered owners or parties related to the owners may be notified regarding those vehicles requiring attention for upgrades, safety measures or other actions.

Figure 5C:
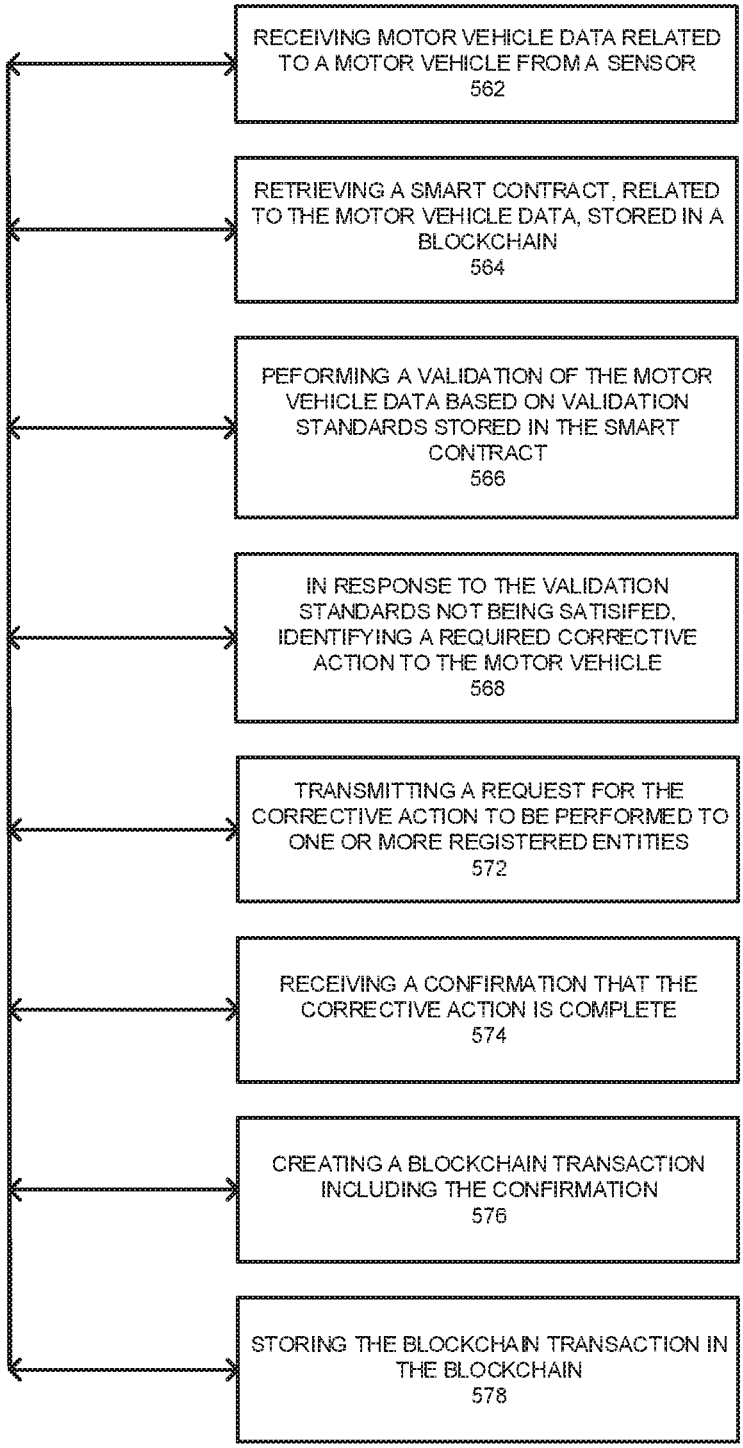
FIG. 5C illustrates a flow diagram of yet another example method of managing vehicle maintenance in a blockchain, according to example embodiments.

FIG. 5C illustrates another flow diagram of another example method of managing vehicle maintenance in a blockchain, according to example embodiments. Referring to FIG. 5C, the method 500C may include receiving motor vehicle data related to a motor vehicle from a sensor 562, retrieving a smart contract, related to the motor vehicle data, stored in a blockchain 564, performing a validation of the motor vehicle data based on validation standards stored in the smart contract 566, in response to the validation standards not being satisfied, identifying a required corrective action to the motor vehicle 568, transmitting a request for the corrective action to be performed to one or more registered entities 572, receiving a confirmation that the corrective action is complete 574, creating a blockchain transaction comprising the confirmation 576, and storing the blockchain transaction in the blockchain 578.

Another example embodiment may include a system that includes a motor vehicle, a computing entity configured to receive motor vehicle data related to the motor vehicle from a sensor, retrieve a smart contract, related to the motor vehicle data, stored in a blockchain, perform a validation of the motor vehicle data based on validation standards stored in the smart contract, in response to the validation standards not being satisfied, identify a required corrective action to the motor vehicle, and one or more registered entities configured to receive a request for the corrective action to be performed, and the computing entity is configured to receive a confirmation that the corrective action is complete, create a blockchain transaction comprising the confirmation, and store the blockchain transaction in the blockchain.

Figure 6A:
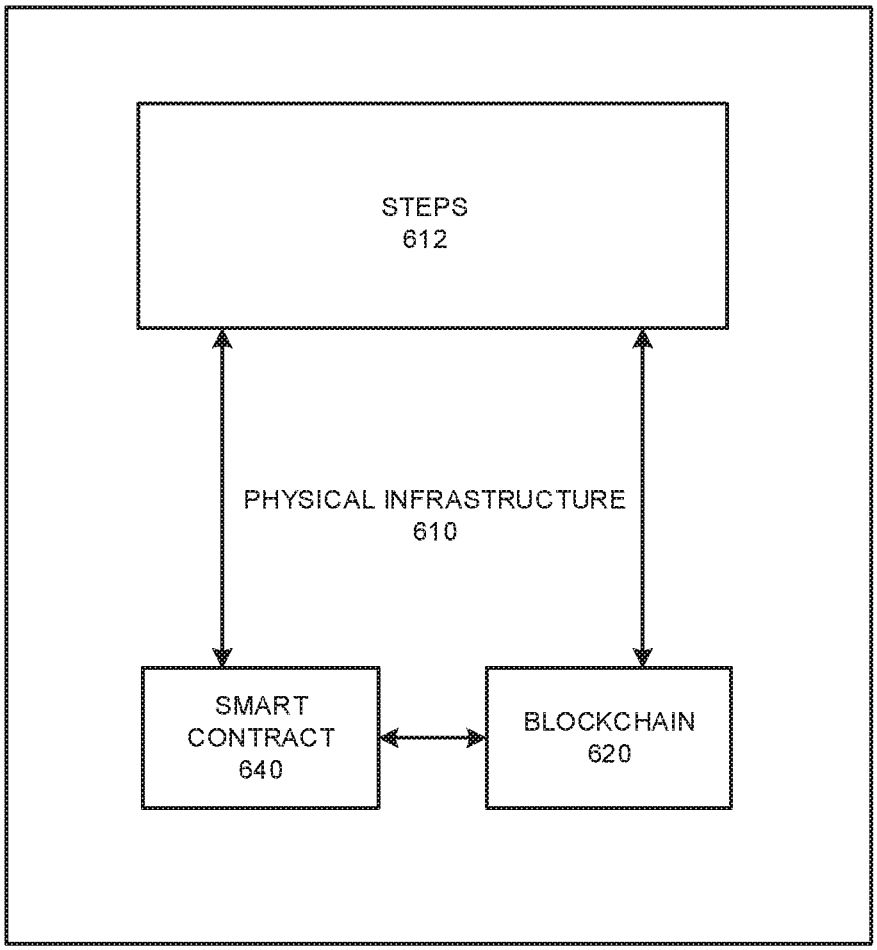
FIG. 6A illustrates an example physical infrastructure configured to perform various operations on the blockchain in accordance with one or more operations described herein, according to example embodiments.

FIG. 6A illustrates an example physical infrastructure configured to perform various operations on the blockchain in accordance with one or more of the example methods of operation according to example embodiments. Referring to FIG. 6A, the example configuration 600A includes a physical infrastructure 610 with a blockchain 620 and a smart contract 640, which may execute any of the operational steps 612 included in any of the example embodiments. The steps/operations 612 may include one or more of the steps described or depicted in one or more flow diagrams and/or logic diagrams. The steps may represent output or written information that is written or read from one or more smart contracts 640 and/or blockchains 620 that reside on the physical infrastructure 610 of a computer system configuration. The data can be output from an executed smart contract 640 and/or blockchain 620. The physical infrastructure 610 may include one or more computers, servers, processors, memories, and/or wireless communication devices.

Figure 6B:
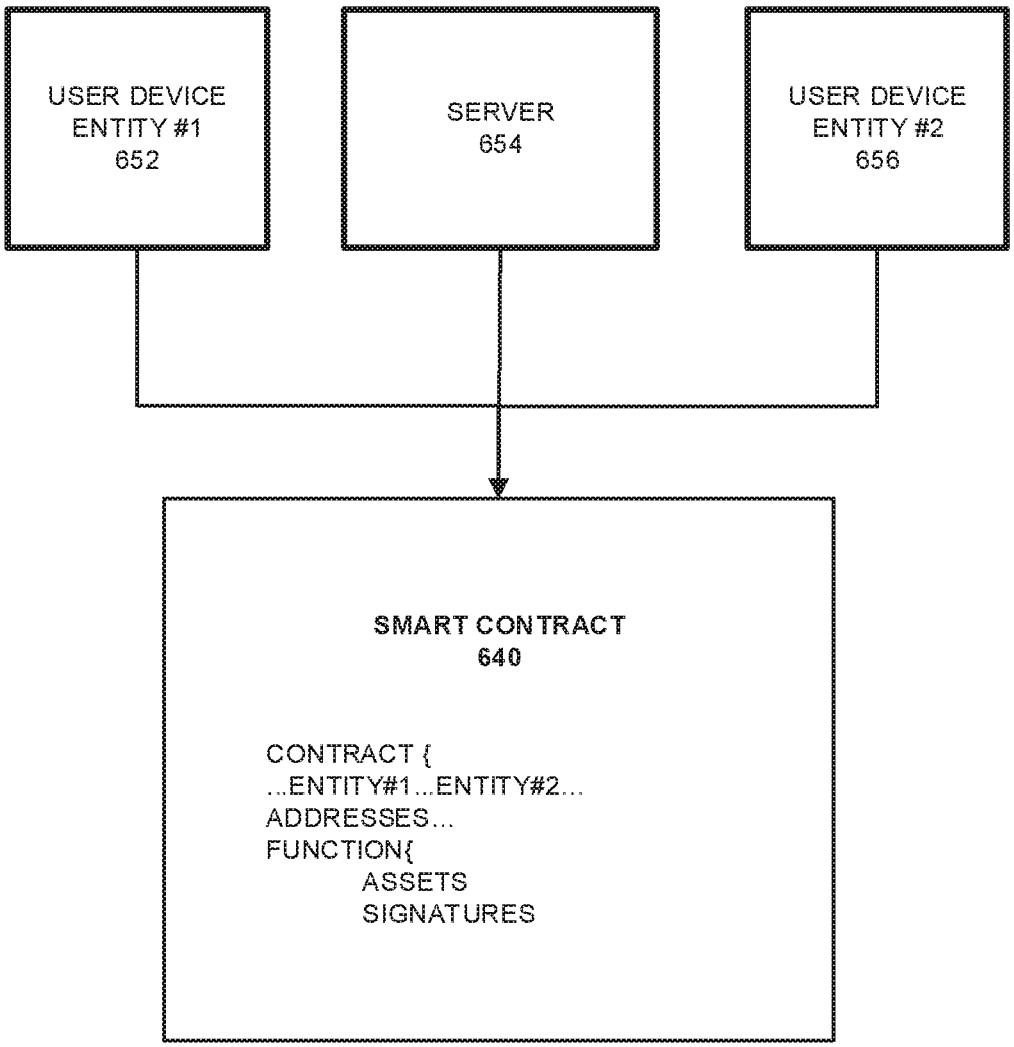
FIG. 6B illustrates an example smart contract configuration among contracting parties and a mediating server configured to enforce smart contract terms on a blockchain, according to example embodiments.

FIG. 6B illustrates an example smart contract configuration among contracting parties and a mediating server configured to enforce the smart contract terms on the blockchain according to example embodiments. Referring to FIG. 6B, the configuration 600B may represent a communication session, an asset transfer session or a process or procedure that is driven by a smart contract 640 which explicitly identifies one or more user devices 652 and/or 656. The execution, operations and results of the smart contract execution may be managed by a server 654. Content of the smart contract 640 may require digital signatures by one or more of the entities 652 and 656 which are parties to the smart contract transaction. The results of the smart contract execution may be written to a blockchain as a blockchain transaction.

The above embodiments may be implemented in hardware, in a computer program executed by a processor, in firmware, or in a combination of the above. A computer program may be embodied on a computer readable medium, such as a storage medium. For example, a computer program may reside in random access memory ("RAM"), flash memory, read-only memory ("ROM"), erasable programmable read-only memory ("EPROM"), electrically erasable programmable read-only memory ("EEPROM"), registers, hard disk, a removable disk, a compact disk read-only memory ("CD-ROM"), or any other form of storage medium known in the art.

An exemplary storage medium may be coupled to the processor such that the processor may read information from, and write information to, the storage medium. In the alternative, the storage medium may be integral to the processor. The processor and the storage medium may reside in an application specific integrated circuit ("ASIC"). In the alternative, the processor and the storage medium may reside as discrete components. For example, FIG. 7 illustrates an example computer system architecture 700, which may represent or be integrated in any of the above-described components, etc.

Figure 7:
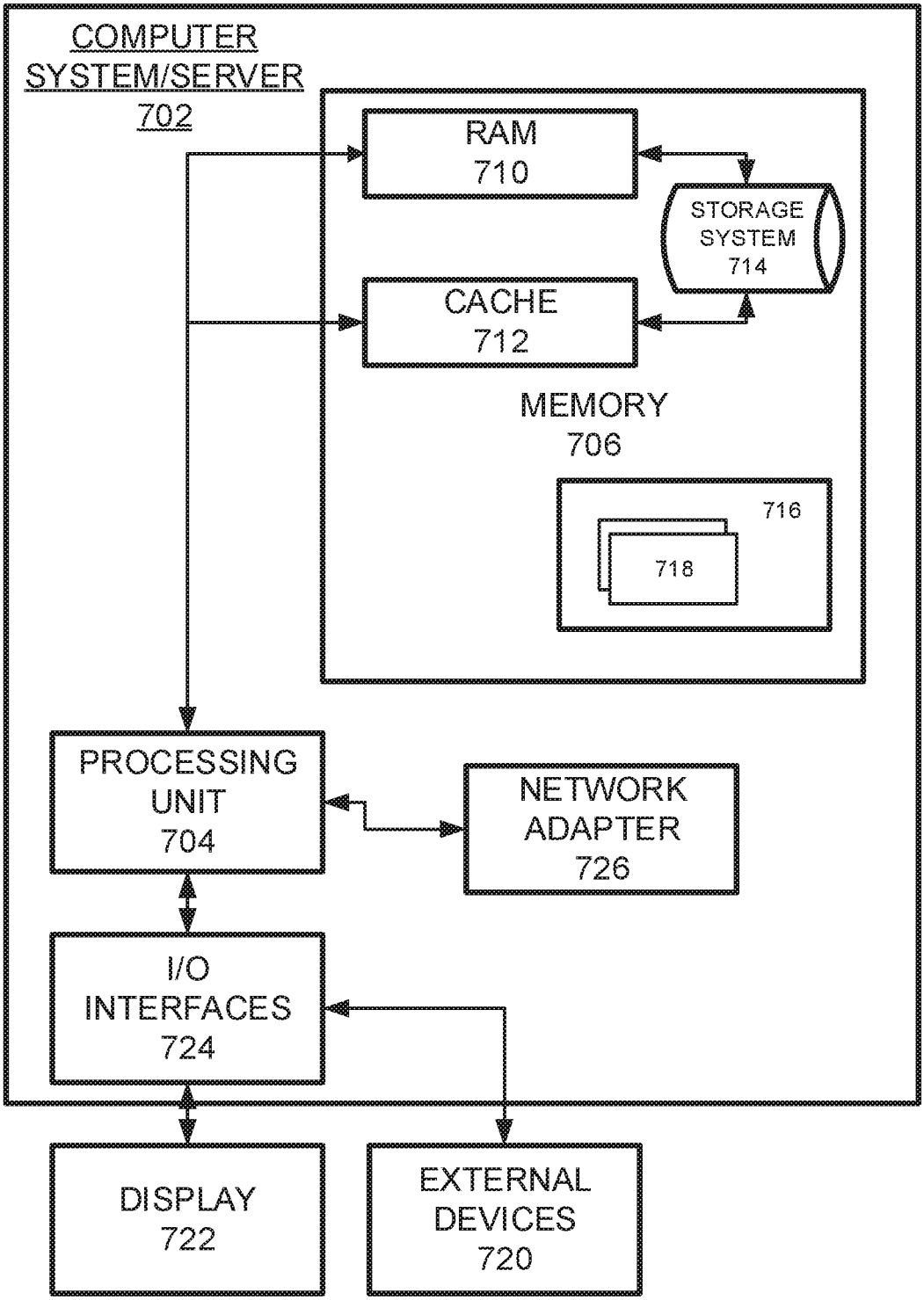
FIG. 7 illustrates an example computer system configured to support one or more of the example embodiments.

FIG. 7 is not intended to suggest any limitation as to the scope of use or functionality of embodiments of the application described herein. Regardless, the computing node 700 is capable of being implemented and/or performing any of the functionality set forth hereinabove.

In computing node 700 there is a computer system/server 702, which is operational with numerous other general purpose or special purpose computing system environments or configurations. Examples of well-known computing systems, environments, and/or configurations that may be suitable for use with computer system/server 702 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 702 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 702 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 7, computer system/server 702 in cloud computing node 700 is shown in the form of a general-purpose computing device. The components of computer system/server 702 may include, but are not limited to, one or more processors or processing units 704, a system memory 706, and a bus that couples various system components including system memory 706 to processor 704.

The bus represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 702 typically includes a variety of computer system readable media. Such media may be any available media that is accessible by computer system/server 702, and it includes both volatile and non-volatile media, removable and non-removable media. System memory 706, in one embodiment, implements the flow diagrams of the other figures. The system memory 706 can include computer system readable media in the form of volatile memory, such as random access memory (RAM) 710 and/or cache memory 712. Computer system/server 702 may further include other removable/non-removable, volatile/non-volatile computer system storage media. By way of example only, storage system 714 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to the bus by one or more data media interfaces. As will be further depicted and described below, memory 706 may include at least one program product having a set (e.g., at least one) of program modules that are configured to carry out the functions of various embodiments of the application.

Program/utility 716, having a set (at least one) of program modules 718, may be stored in memory 706 by way of example, and not limitation, as well as an operating system, one or more application programs, other program modules, and program data. Each of the operating system, one or more application programs, other program modules, and program data or some combination thereof, may include an implementation of a networking environment. Program modules 718 generally carry out the functions and/or methodologies of various embodiments of the application as described herein.

As will be appreciated by one skilled in the art, aspects of the present application may be embodied as a system, method, or computer program product. Accordingly, aspects of the present application may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present application may take the form of a computer program product embodied in one or more computer readable medium(s) having computer readable program code embodied thereon.

Computer system/server 702 may also communicate with one or more external devices 720 such as a keyboard, a pointing device, a display 722, etc.; one or more devices that enable a user to interact with computer system/server 702; and/or any devices (e.g., network card, modem, etc.) that enable computer system/server 702 to communicate with one or more other computing devices. Such communication can occur via I/O interfaces 724. Still yet, computer system/server 702 can communicate with one or more networks such as a local area network (LAN), a general wide area network (WAN), and/or a public network (e.g., the Internet) via network adapter 726. As depicted, network adapter 726 communicates with the other components of computer system/server 702 via a bus. It should be understood that although not shown, other hardware and/or software components could be used in conjunction with computer system/server 702. Examples, include, but are not limited to: microcode, device drivers, redundant processing units, external disk drive arrays, RAID systems, tape drives, and data archival storage systems, etc.

Although an exemplary embodiment of at least one of a system, method, and non-transitory computer readable medium has been illustrated in the accompanied drawings and described in the foregoing detailed description, it will be understood that the application is not limited to the embodiments disclosed, but is capable of numerous rearrangements, modifications, and substitutions as set forth and defined by the following claims. For example, the capabilities of the system of the various figures can be performed by one or more of the modules or components described herein or in a distributed architecture and may include a transmitter, receiver or pair of both. For example, all or part of the functionality performed by the individual modules, may be performed by one or more of these modules. Further, the functionality described herein may be performed at various times and in relation to various events, internal or external to the modules or components. Also, the information sent between various modules can be sent between the modules via at least one of: a data network, the Internet, a voice network, an Internet Protocol network, a wireless device, a wired device and/or via plurality of protocols. Also, the messages sent or received by any of the modules may be sent or received directly and/or via one or more of the other modules.

One skilled in the art will appreciate that a "system" could be embodied as a personal computer, a server, a console, a personal digital assistant (PDA), a cell phone, a tablet computing device, a smartphone or any other suitable computing device, or combination of devices. Presenting the above-described functions as being performed by a "system" is not intended to limit the scope of the present application in any way, but is intended to provide one example of many embodiments. Indeed, methods, systems and apparatuses disclosed herein may be implemented in localized and distributed forms consistent with computing technology.

It should be noted that some of the system features described in this specification have been presented as modules, in order to more particularly emphasize their implementation independence. For example, a module may be implemented as a hardware circuit comprising custom very large scale integration (VLSI) circuits or gate arrays, off-the-shelf semiconductors such as logic chips, transistors, or other discrete components. A module may also be implemented in programmable hardware devices such as field programmable gate arrays, programmable array logic, programmable logic devices, graphics processing units, or the like.

A module may also be at least partially implemented in software for execution by various types of processors. An identified unit of executable code may, for instance, comprise one or more physical or logical blocks of computer instructions that may, for instance, be organized as an object, procedure, or function. Nevertheless, the executables of an identified module need not be physically located together, but may comprise disparate instructions stored in different locations which, when joined logically together, comprise the module and achieve the stated purpose for the module. Further, modules may be stored on a computer-readable medium, which may be, for instance, a hard disk drive, flash device, random access memory (RAM), tape, or any other such medium used to store data.

Indeed, a module of executable code could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

It will be readily understood that the components of the application, as generally described and illustrated in the figures herein, may be arranged and designed in a wide variety of different configurations. Thus, the detailed description of the embodiments is not intended to limit the scope of the application as claimed, but is merely representative of selected embodiments of the application.

One having ordinary skill in the art will readily understand that the above may be practiced with steps in a different order, and/or with hardware elements in configurations that are different than those which are disclosed. Therefore, although the application has been described based upon these preferred embodiments, it would be apparent to those of skill in the art that certain modifications, variations, and alternative constructions would be apparent.

While preferred embodiments of the present application have been described, it is to be understood that the embodiments described are illustrative only and the scope of the application is to be defined solely by the appended claims when considered with a full range of equivalents and modifications (e.g., protocols, hardware devices, software platforms etc.) thereto.

What is claimed is:

1. A method, comprising:

receiving motor vehicle data related to a motor vehicle from a sensor;

retrieving a smart contract, related to the motor vehicle data, stored in a blockchain;

performing a validation of the motor vehicle data based on validation standards stored in the smart contract;

in response to the validation standards not being satisfied, identifying a required corrective action to the motor vehicle;

transmitting, to one or more registered entities, a request for the corrective action to be performed by the one or more registered entities;

receiving a confirmation that the corrective action is complete;

creating a blockchain transaction comprising the confirmation; and storing the blockchain transaction in the blockchain.

2. The method of claim 1, further comprising:

creating a block on the blockchain responsive to a motor vehicle event occurrence.

3. The method of claim 2, wherein the motor vehicle event comprises a change in vehicle operating parameters, as determined by the sensor, which comprises one or more on-board vehicle sensors, and an initial vehicle startup operation.

4. The method of claim 2, further comprising:

receiving an updated status from the one or more registered entities regarding a change in status of the motor vehicle.

5. The method of claim 4, wherein the updated status comprises motor vehicle repair data, dates motor vehicle repairs were performed, and certification data.

6. The method of claim 4, further comprising:

receiving a validation report from a third party agency, responsive to the updated status being received and approved by the third party agency.

7. The method of claim 6, further comprising:

storing the validation report in the blockchain.

8. A system, comprising:

a processor configured to receive motor vehicle data related to a motor vehicle from a sensor;

retrieve a smart contract, related to the motor vehicle data, stored in a blockchain;

perform a validation of the motor vehicle data based on validation standards stored in the smart contract;

in response to the validation standards not being satisfied, identify a required corrective action to the motor vehicle; and transmit, to one or more registered entities, a request for the corrective action to be performed by the one or more registered entities, wherein the processor is further configured to receive a confirmation that the corrective action is complete, create a blockchain transaction comprising the confirmation, and store the blockchain transaction in the blockchain.

9. The system of claim 8, wherein the processor is further configured to create a block on the blockchain responsive to a motor vehicle event occurrence.

10. The system of claim 9, wherein the motor vehicle event comprises a change in vehicle operating parameters, as determined by the sensor, which comprises one or more on-board vehicle sensors, and an initial vehicle startup operation.

11. The system of claim 9, wherein the processor is further configured to receive an updated status from the one or more registered entities with regard to a change in status of the motor vehicle.

12. The system of claim 11, wherein the updated status comprises motor vehicle repair data, dates motor vehicle repairs were performed, and certification data.

13. The system of claim 9, wherein the processor is further configured to receive a validation report from a third party agency, responsive to the updated status being received and approved by the third party agency.

14. The system of claim 13, wherein the processor is further configured to store the validation report in the blockchain.

15. A non-transitory computer readable storage medium configured to store instructions that when executed cause a processor to perform:

receiving motor vehicle data related to a motor vehicle from a sensor;

retrieving a smart contract, related to the motor vehicle data, stored in a blockchain;

performing a validation of the motor vehicle data based on validation standards stored in the smart contract;

in response to the validation standards not being satisfied, identifying a required corrective action to the motor vehicle;

transmitting, to one or more registered entities, a request for the corrective action to be performed by the one or more registered entities;

receiving a confirmation that the corrective action is complete;

creating a blockchain transaction comprising the confirmation; and storing the blockchain transaction in the blockchain.

16. The non-transitory computer readable storage medium of claim 15, wherein the processor is further configured to perform:

creating a block on the blockchain responsive to a motor vehicle event occurrence.

17. The non-transitory computer readable storage medium of claim 16, wherein the motor vehicle event comprises a change in vehicle operating parameters, as determined by the sensor, which comprises one or more on-board vehicle sensors, and an initial vehicle startup operation.

18. The non-transitory computer readable storage medium of claim 16, wherein the processor is further configured to perform:

receiving an updated status from the one or more registered entities regarding a change in status of the motor vehicle.

19. The non-transitory computer readable storage medium of claim 18, wherein the updated status comprises motor vehicle repair data, dates motor vehicle repairs were performed, and certification data.

20. The non-transitory computer readable storage medium of claim 16, wherein the processor is further configured to perform:

receiving a validation report from a third party agency, responsive to the updated status being received and approved by the third party agency; and storing the validation report in the blockchain.

* * * * *